US007029385B1

(12) United States Patent
Wang

(10) Patent No.: US 7,029,385 B1
(45) Date of Patent: Apr. 18, 2006

(54) TWO-WAY ROTARY MULTI-FUNCTION POLISHER

(76) Inventor: Fu-Chun Wang, No 59 North Daxue Road, Yangzhou City Jiangsu Province (CN)

( * ) Notice: Subject to any disclaimer, the term of this patent is extended or adjusted under 35 U.S.C. 154(b) by 0 days.

(21) Appl. No.: 11/161,241

(22) Filed: Jul. 27, 2005

(51) Int. Cl.
*B24B 23/00* (2006.01)

(52) U.S. Cl. ..... 451/359; 451/270; 451/271

(58) Field of Classification Search ..... 451/359, 451/270, 271
See application file for complete search history.

(56) References Cited

U.S. PATENT DOCUMENTS 4,754,575 A * 7/1988 Schneider ..... 451/271
4,905,772 A * 3/1990 Honsa et al. ..... 173/162.1
6,905,401 B1 * 6/2005 Chen ..... 451/342
2002/0151262 A1 * 10/2002 Berger et al. ..... 451/358
2002/0182993 A1 * 12/2002 Ueno ..... 451/359
2004/0082285 A1 * 4/2004 Bohler ..... 451/359
2004/0248505 A1 * 12/2004 Chen ..... 451/340

* cited by examiner

*Primary Examiner*—Joseph J. Hail, III
*Assistant Examiner*—Robert Scruggs
(74) *Attorney, Agent, or Firm*—W. Wayne Liauh

(57) ABSTRACT

The present invention relates to a two-way rotary multi-function polisher, which comprises an input shaft driven to rotate by a power resource, a first spur gear and a second spur gear engagably transmitted by the end of input shaft; wherein the first spur gear is in response to the second spur gear and fixed to an output shaft having an inner polishing disc at the end thereof, so as to rotate the inner polishing disc in the first direction, while the second spur gear is coupled to a sleeve having an outer polishing disc at the end thereof and disposed to the exterior of output shaft by a bearing, so as to rotate the outer polishing disc in the second direction; hence, while the input shaft rotating, the inner and the outer polishing disc can respectively rotate in the opposite direction, enabling the two-way polishing and grinding to be achieved.

8 Claims, 5 Drawing Sheets

TWO-WAY ROTARY MULTI-FUNCTION POLISHER

BACKGROUND OF THE INVENTION

1. Field of the Invention

The present invention relates to a two-way rotary multi-function polisher that can greatly reduce the reaction force and can easily be operated, while the user proceeds with the polishing and grinding.

2. Description of the Prior Arts

Polisher is commonly used in the polishing and grinding for woods, stone materials, or metal materials. As shown in FIG. 1, a conventional hand-held polisher comprises a rotating shaft 1 which is driven to rotate by a power resource. At the end of said rotating shaft 1 is provided with a coupling member 2 as well as a fixing member 3 for disposing a polishing disc 4. The polishing disc 4 is driven to rotate to proceed with the polishing and grinding by the rotating shaft 1. However, while in the polishing and grinding, the workpiece is fixed and the polishing disc 4 rotates in a single direction, the reaction force opposite to the polisher will occur; hence, the user has to hold and operate the polisher hard. In addition, the polishing disc 4 rotates in the single direction, so the patterns for the polishing and grinding will also appear on the workpiece in the single direction.

The present invention has arisen to mitigate and/or obviate the afore-described disadvantages.

SUMMARY OF THE INVENTION

The primary objective of the present invention is to provide a two-way rotary multi-function polisher, which can use a power resource to drive the gear assembly to rotate, and can simultaneously drive an inner polishing disc and an outer polishing disc to rotate in the opposite direction as well; as a result, while in the polishing and grinding, the reaction forces which respectively occur on said inner and said outer polishing disc can be counteracted by each other, whereby the polisher will be easier to hold by the user.

The secondary objective of the present invention is to provide a two-way rotary multi-function polisher, which can use a power resource to drive the gear assembly to rotate, and can simultaneously drive the inner polishing disc and the outer polishing disc to rotate in the opposite direction; as a result, while in the polishing and grinding, the patterns for the polishing and grinding appear on the workpiece can adversely be crossed, in such a manner that the polishing and grinding effect will greatly be enhanced.

The third objective of the present invention is to provide a two-way rotary multi-function polisher that comprises an output shaft having a water outlet, so as to supply water to the polishing disc, after the water outlet connects to a water-feeding piping, whereby enabling the wet polishing and grinding to be proceeded as well, while in the polishing and grinding.

Another objective of the present invention is to provide a two-way rotary multi-function polisher that the two nylon self-adhesive pads such as magic pads are respectively provided on the inner and the outer polishing disc, so as to replace the polishing pad according to the requirement, in such a manner that the replacement for the polishing pad will be easier.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
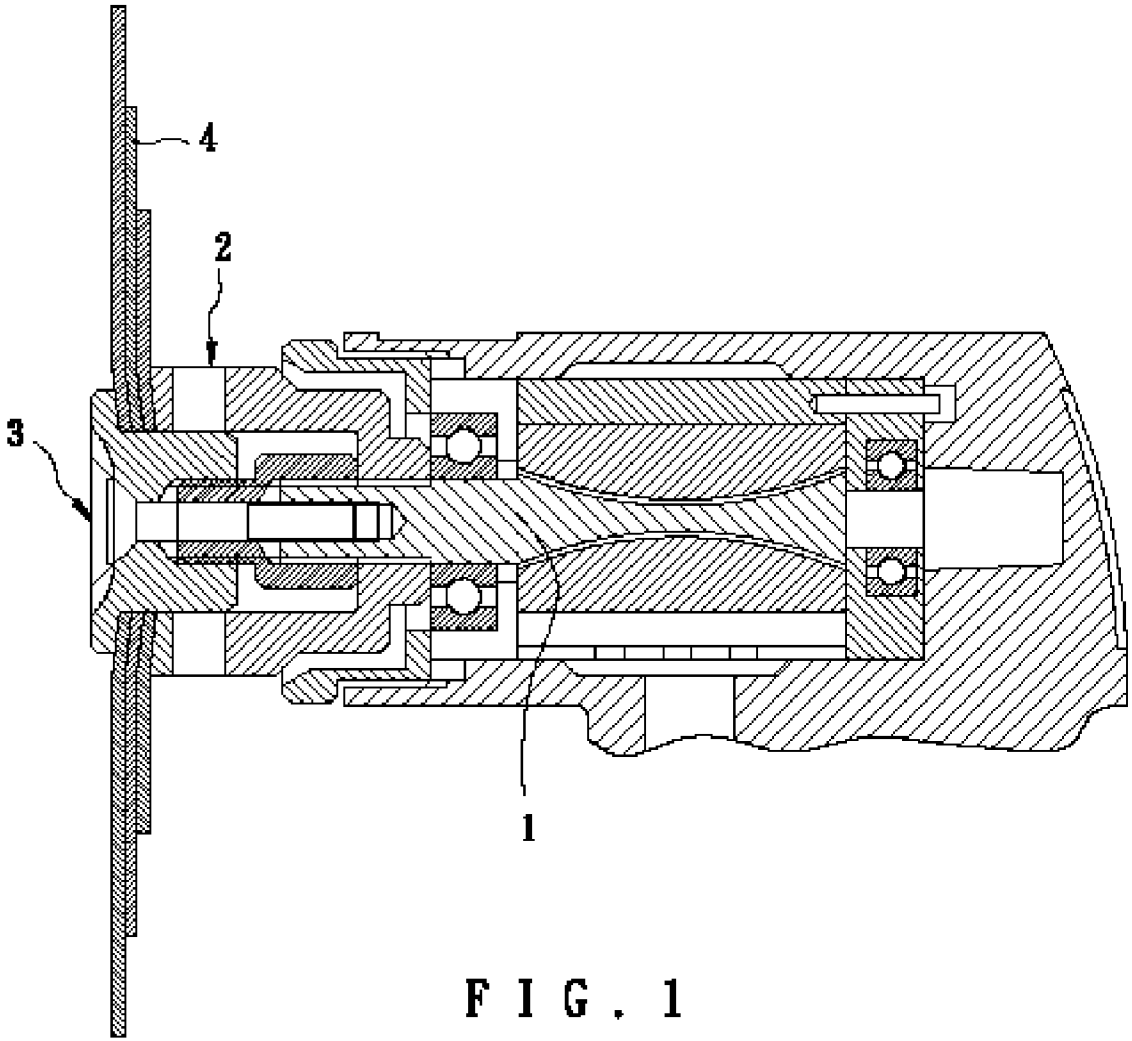
FIG. 1 is a cross sectional view of showing a conventional polisher.
Figure 2:
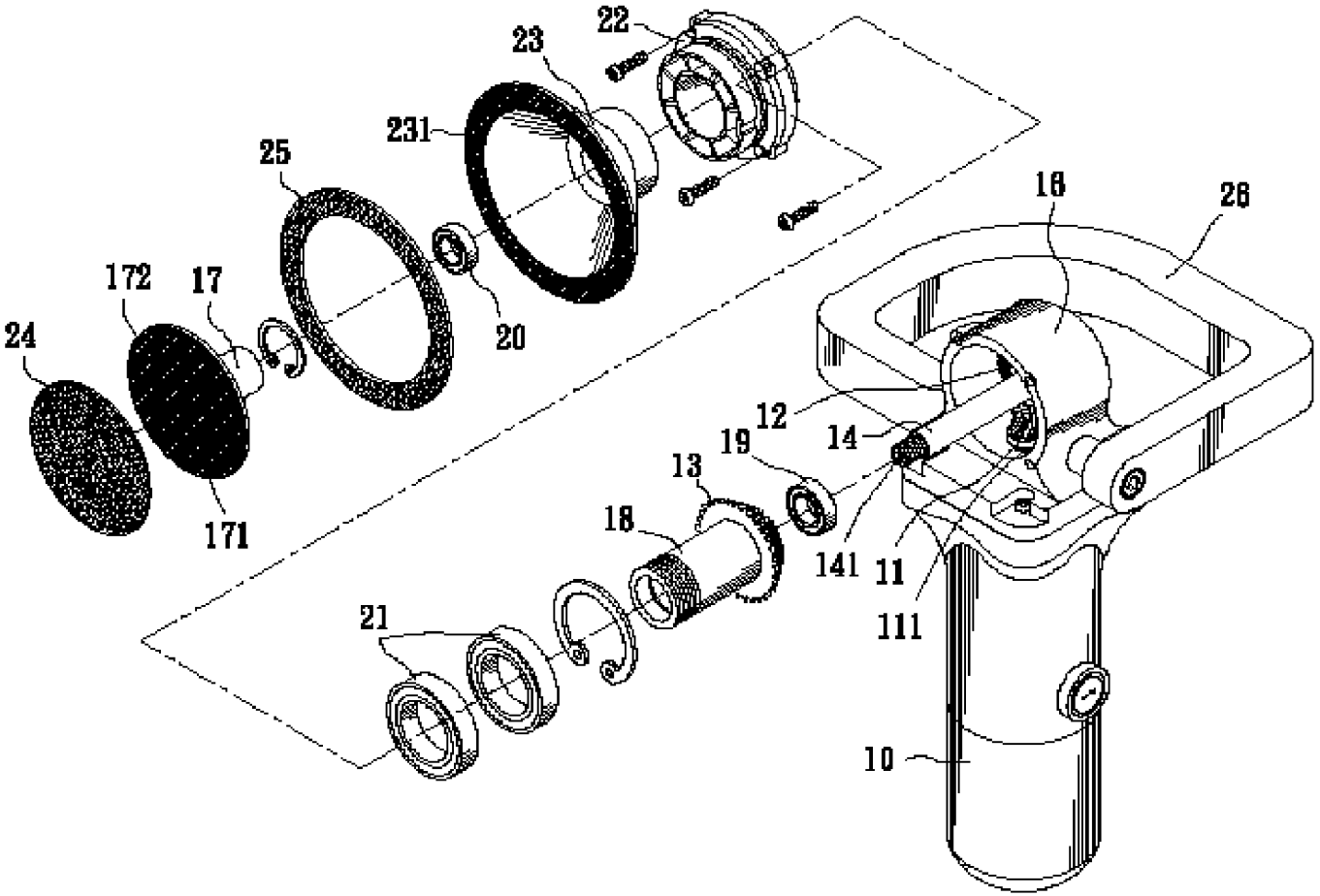
FIG. 2 is an exploded view of a two-way rotary multi-function polisher in accordance with the present invention.
Figure 3:
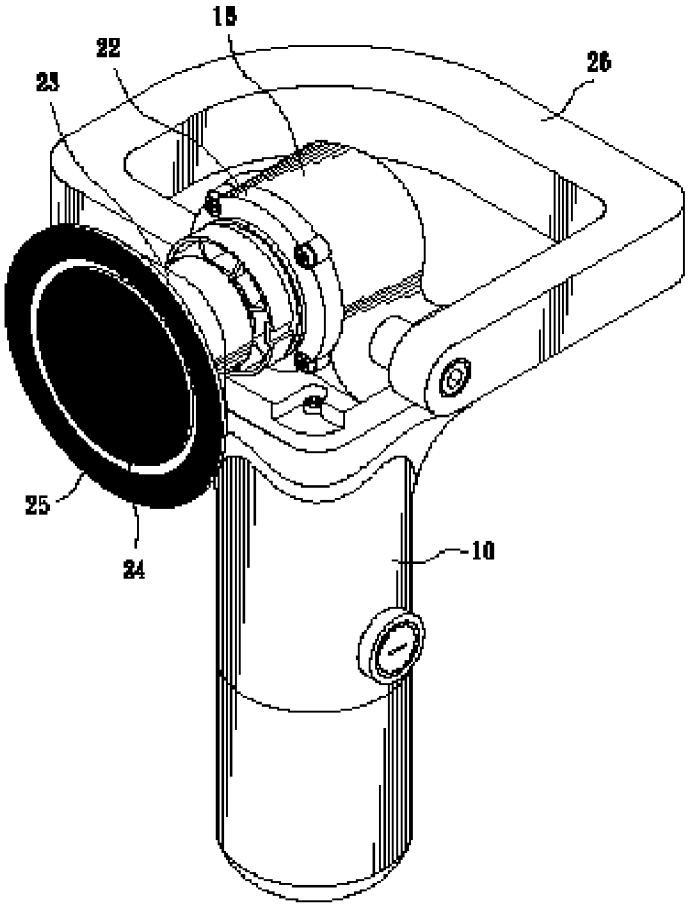
FIG. 3 is an assembly view of the two-way rotary multi-function polisher in accordance with the present invention.
Figure 4:
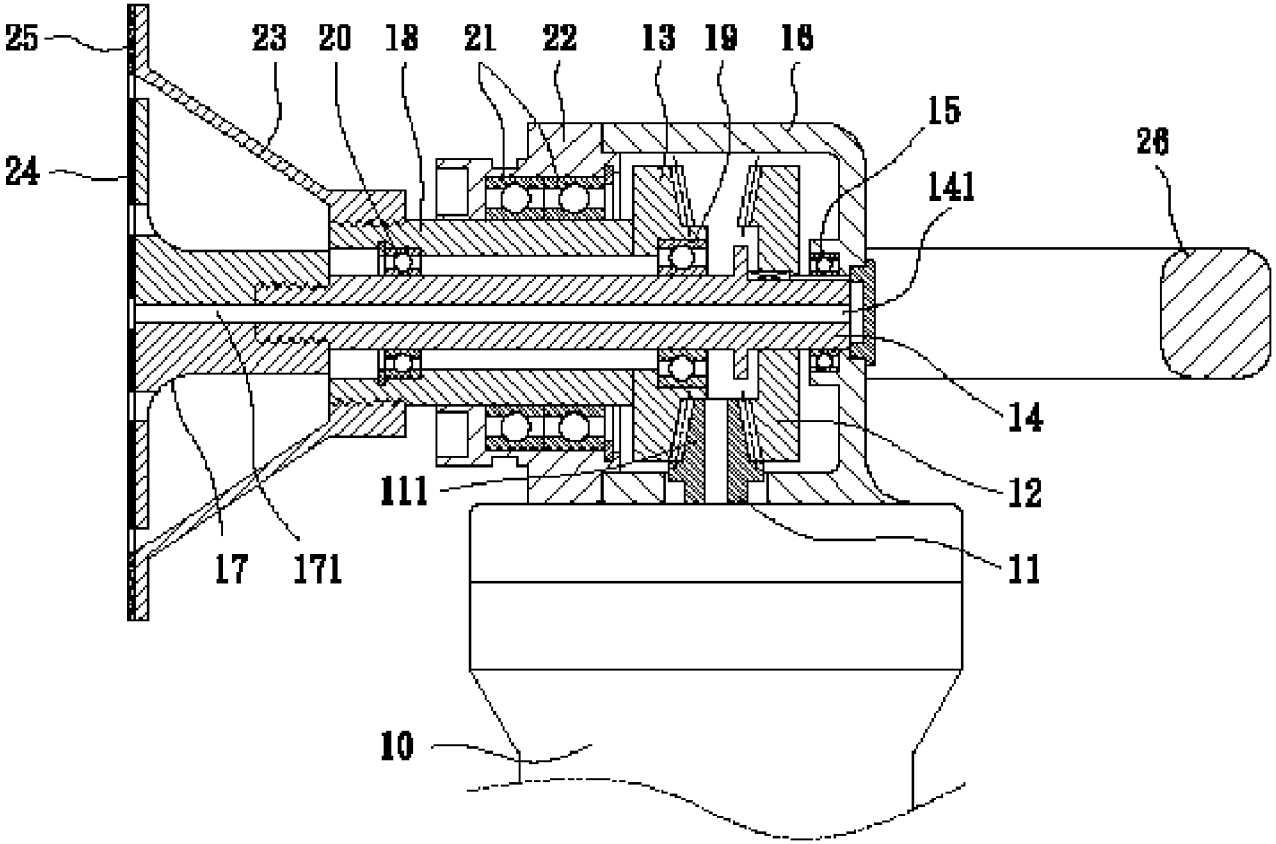
FIG. 4 is a cross sectional view of a part of the two-way rotary multi-function polisher in accordance with the present invention.

Referring to FIGS. 2–4, a two-way rotary multi-function polisher in accordance with the present invention is shown and comprises a power resource (for example, an electric motor or an air motor) for driving an input shaft 11 to rotate, a helical gear 111 which is mounted at the end of said input shaft 11, two opposite spur gears including a first spur gear 12 and a second spur gear 13, each of which is engaged with the helical gear 111. Due to the first spur gear 12 and the second spur gear 13 are respectively disposed in the opposite direction, while the helical gear 111 engagably drives the first spur gear 12 and the second spur gear 13, said first spur gear 12 and said second spur gear 13 will simultaneously rotate in the opposite direction. The first spur gear 12 is fixed to an output shaft 14, one end of which is disposed to a casing 16 by a bearing 15. Other end of the output shaft 14 is coupled to an inner polishing disc 17, by using a threaded section of said output shaft 14, so that the output shaft 14 will drive the inner polishing disc 17 to rotate in the first direction (such as the clockwise direction). Furthermore, a water outlet 141 is defined at the output shaft 14, so that the water can be supplied to the front end of said output shaft 14 through a through hole 171 of the inner polishing disc 17, after the water outlet 141 connects to a water-feeding piping, whereby the water can be sprayed to the workpiece, and then the wet polishing and grinding can be proceeded by the user. A grip 26 for the user's holding with other hand is fixed to the casing 16. The second spur gear 13 is coupled to a sleeve 18 and is disposed to the exterior of the output shaft 14 by using a bearing 19, 20; further, by using a plurality of bearings 21, the exterior of the sleeve 18 is mounted to an end cap 22 on the casing 16, so that the second spur gear 13 can drive the sleeve 18 to rotate. The end portion of the sleeve 18 is coupled to the outer polishing disc 23, by using a threaded section of said sleeve 18, wherein the surfaces of the outer polishing disc 23 and the inner polishing disc 17 respectively abut against the end portion of the sleeve 18, whereby the outer polishing disc 23 can rotate in the second direction (such as the anti-clockwise direction). Moreover, the two nylon self-adhesive pads 172, 231 (such as magic pads) and the two polishing pads 24, 25 can respectively be attached to the surfaces of the inner polishing disc 17 and the outer polishing disc 23, in such a manner that the two thick, medium or thin polishing pads 24, 25 can be replaced easily.

Figure 5:
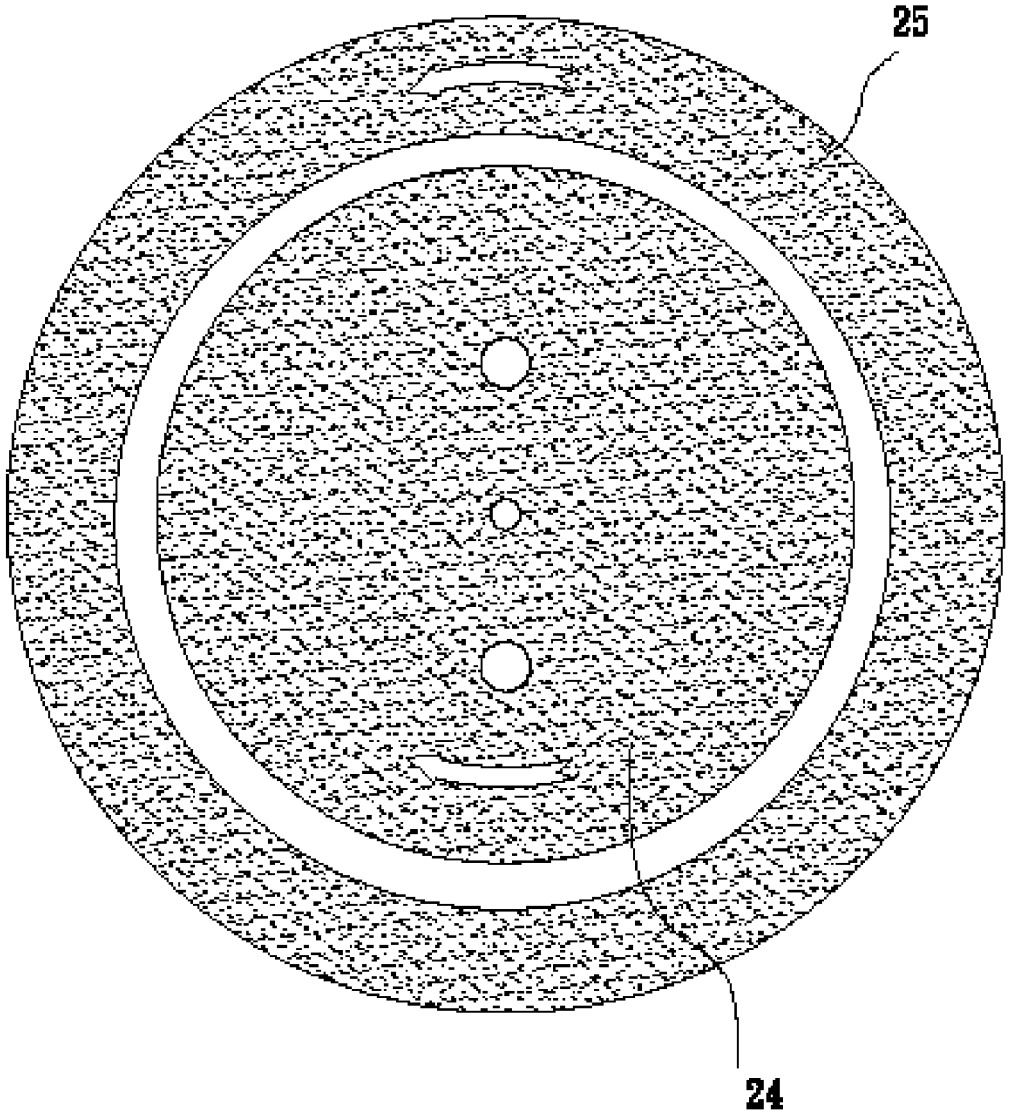
FIG. 5 is an operational view of two polishing discs of the two-way rotary multi-function polisher in accordance with the present invention.

Referring to FIGS. 4–5, a two-way rotary multi-function polisher in accordance with the present invention in which the helical gear 111 can engagably drive the first spur gear 12 and the second spur gear 13 to rotate, by using the power resource, wherein said first spur gear 12 is in response to said second spur gear 13. As a result, the inner polishing disc 17 at the end of the output shaft 14 and the outer polishing disc 23 at the end of the sleeve 18 will simultaneously rotate in the opposite direction, in such a manner that the reaction forces which respectively occur on the two polishing pads 24, 25 will be counteracted by each other, while in the polishing and grinding. Therefore, the user will be easy to hold and operate the polisher. It is to be noted that the patterns for the polishing and grinding are adversely crossed, hence, the effect of said polishing and grinding will greatly be enhanced.

While we have shown and described various embodiments in accordance with the present invention, it should be clear to those skilled in the art that further embodiments may be made without departing from the scope of the present invention.

What is claimed is:

1. A two-way rotary multi-function polisher comprising:

an input shaft driven to rotate by a power resource;

a first spur gear and a second spur gear engagably transmitted by the end of said input shaft;

wherein the first spur gear is in response to the second spur gear and is fixed to an output shaft having an inner polishing disc at the end thereof, so as to rotate the inner polishing disc in the first direction, while the second spur gear is coupled to a sleeve having an outer polishing disc at the end thereof and is disposed to the exterior of the output shaft by a bearing, so as to rotate the outer polishing disc in the second direction; hence, while the input shaft rotating, the inner and the outer polishing disc can respectively rotate in the opposite direction, enabling the two-way polishing and grinding to be achieved.

2. The two-way rotary multi-function polisher as claimed in claim 1, wherein the helical gear for engagably transmitting the first spur gear as well as the second spur gear is disposed to the end of the output shaft.

3. The two-way rotary multi-function polisher as claimed in claim 1, wherein the first spur gear and the second spur gear are both bevel gears.

4. The two-way rotary multi-function polisher as claimed in claim 1, wherein one end of the output shaft is mounted to the casing by a bearing, another end of said output shaft is coupled to the inner polishing disc by using the threaded section of said output shaft.

5. The two-way rotary multi-function polisher as claimed in claim 1, wherein a water outlet is defined at the output shaft, after said water outlet connects to a water-feeding piping, enabling the wet polishing and grinding to be proceeded.

6. The two-way rotary multi-function polisher as claimed in claim 1, wherein one end of the sleeve is coupled to the outer polishing disc by using the threaded section of said sleeve.

7. The two-way rotary multi-function polisher as claimed in claim 1, wherein the exterior of said sleeve is fixed to an end cap on the casing by using another bearing.

8. The two-way rotary multi-function polisher as claimed in claim 1, wherein the two nylon self-adhesive pads are respectively provided on the surfaces of the inner and the outer polishing disc in such a manner that the two polishing pads can respectively be attached to one of said nylon self-adhesive pads.

* * * * *